United States Patent [19]

Pasternack et al.

[11] 4,367,822

[45] Jan. 11, 1983

[54] AIRTIGHT RECEPTACLE LOCK FOR EMERGENCY RESPIRATORS

[75] Inventors: Adalbert Pasternack, Bad Schwartau; Claus-Dieter Hinz, Lübeck, both of Fed. Rep. of Germany

[73] Assignee: Drägerwerk Aktiengesellschaft, Fed. Rep. of Germany

[21] Appl. No.: 253,542

[22] Filed: Apr. 13, 1981

[30] Foreign Application Priority Data

Aug. 28, 1980 [DE] Fed. Rep. of Germany ..... 3032416

[51] Int. Cl.[3] ..... B65D 55/02; B65D 55/06

[52] U.S. Cl. ..... 220/265; 220/268; 229/45 R; 206/634; 206/1.5

[58] Field of Search ..... 206/634, 523, 525, 527, 206/1.5; 229/45; 220/265, 266, 267, 268, 269, 315

[56] References Cited

U.S. PATENT DOCUMENTS

| | | | |
|---|---|---|---|
| 2,809,777 | 10/1957 | Davidson | 229/45 |
| 3,259,300 | 7/1966 | Pietrzak et al. | 229/45 |
| 3,726,394 | 4/1973 | Wachter | 206/523 |
| 3,817,419 | 6/1974 | Moller et al. | 220/315 |
| 4,234,099 | 11/1980 | Tarro | 220/269 |

*Primary Examiner*—William T. Dixson, Jr.
*Attorney, Agent, or Firm*—McGlew and Tuttle

[57] ABSTRACT

In a gas tight receptacle, particularly for an emergency respirator, a safety lock is disclosed which comprises an eyelet or slotway in a bottom and cover part of the receptacle. Both eyelets or slotways are engaged in a fixed manner by elastic tongues of a locking member. The locking member has a weakened portion in the area of the seal so that it can be broken to permit the full opening of the receptacle.

4 Claims, 3 Drawing Figures

AIRTIGHT RECEPTACLE LOCK FOR EMERGENCY RESPIRATORS

FIELD AND BACKGROUND OF THE INVENTION

The present invention relates in general to gas tight respirator receptacles and, in particular, to a new and useful gas tight receptacle for an emergency respirator which includes a lock for preventing inadvertent or undesired opening and leakage of the receptacle.

In underground operations, such as in mines, where conditions may be rough, it will happen that the closures of emergency or readiness receptacles of emergency respirators, carried by persons for self-protection, are inadvertently opened after destruction of a lead seal used in the receptacles. Depending on the kind of receptacle, this could become dangerous for the function of the respirator which is packed in the readiness receptacle only if the receptacle is then opened by removal of its cover. In these cases there would then be no assurance that the equipment parts of the respirator, such as the breathing bag, the mouthpiece, and also the hose, etc., would not be damaged also. Such leakage may cause excessive water absorption which too would damage the respirator. If it were possible to hold the cover even with the closure open, at least on the bottom part of the receptacle, if not tightly, at least partly, then reclosing the readiness receptacle would be possible without extensive damage of the respirator and its sensitive parts.

In a known air tight readiness receptacle for emergency respirators, which also consists of two parts, namely a bottom part and a cover, these parts are pressed one on the other with closure means under adjustable contact pressure. At least one bayonet type lock serves as closure means. An oblong slotway, of the lock, disposed in one receptacle part, is inclined and has a serration on the upper inner side thereof. The tip of a bayonet pin engages into the serration. The pin is disposed on the other receptacle part. The bayonet pin, which rotatably passes through the receptacle wall, terminates on the outside of this receptacle part as a crank type operating lever. By the latter, the relative contact pressure of the receptacle parts, separated from each other by seals, is selected by rotation. The operating lever is then fixed in its end position by a lead seal. The soldering of the operating lever in the bushing in the receptacle wall, which here serves primarily for sealing, is at the same time an additional safety against unintentional opening of the emergency or readiness receptacle. This would here mean removal of the cover from the bottom part.

A disadvantage in this design is the extremely great expense of construction, which moreover demands for its function, a possibility of neat engagement of the gear in the serration over the entire path. For the unskilled user, the correct operation of the closure means is difficult to carry out, especially in a situation of possible danger. The receptacle can be opened completely by removal of one receptacle part, e.g. the cover, only after the gear is out of engagement after a full rotation of the operating lever. Yet the user is able to remove the cover unnoticed by the equipment personnel, and also to place it on again. The respirator may then have suffered some damage already. (West German Pat. No. 12 28 145).

SUMMARY OF THE INVENTION

An object of the invention is to provide a gasproof readiness receptacle for respirators which assures that even after the lead seal has been destroyed with subsequent opening of the normal readiness receptacle closure, the receptacle cannot actually be opened fully in an uncontrolled manner.

Another object of the invention is to provide, in a gas tight receptacle which includes a bottom part, a cover part, a seal between the bottom and the cover parts and a closure means for holding the parts together; a safety lock comprising, an eyelet in the cover part, an eyelet in the bottom part, and a locking member having a first elastic tongue and a stop engaged with one of the eyelets to hold the member fixed with respect to the one eyelet and a second elastic tongue engaged with the other eyelet for holding the member fixed with respect to the other eyelet, the locking member having a weakened area adapted to be broken when the cover part is removed from the bottom part.

Another object of the invention is to have the locking member made of brittle plastic such as polycarbonate, or of hardened steel. These materials have sufficient resiliency to permit the operation of the elastic tongues while at the same time having sufficient hardness to permit the breakage of the locking member at its weakened area.

The advantages achieved with the invention reside in a simple and reliable solution. The safety lock can simply be inserted and special mounting tools are not necessary. Due to its easy breaking, it by no means hinders the desired removal of the cover when needed. In all other cases, even with unintentionally opened receptacles, the cover remains on the bottom part of the receptacle. The receptacle closure, as in the instance where the closure is a strap, can be closed again without any great expense for control and labor, with safety from damage to the respirator or its structural parts. The respirator is available for use again in a minimum of time. The two possible materials for the manufacture of the safety lock permit simple and low-cost procurement.

Another object of the invention is to provide such a lock for a gas tight receptacle of an emergency respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
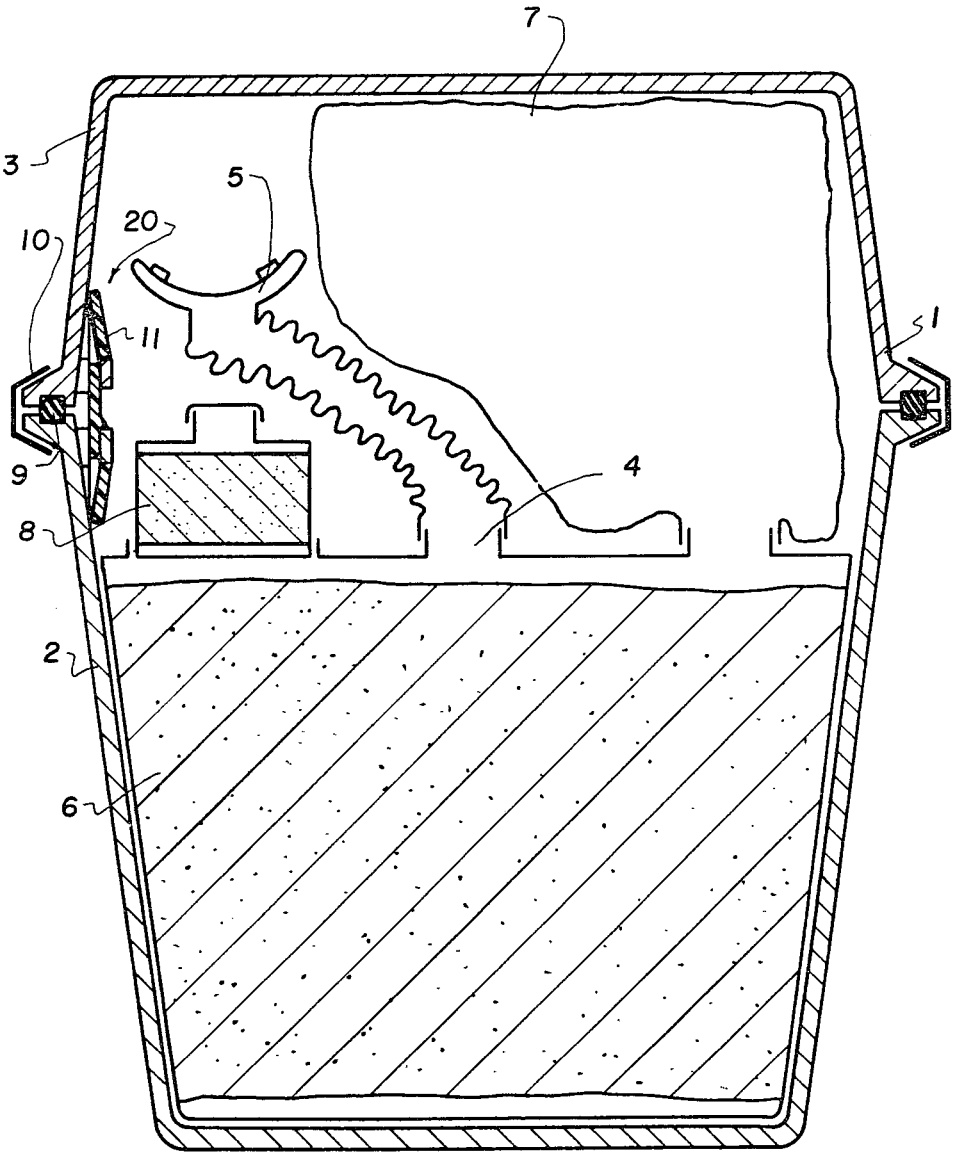
FIG. 1 is a side elevational view of a readiness receptacle, containing a $KO_2$-based respirator with a safety lock.
Figure 2:
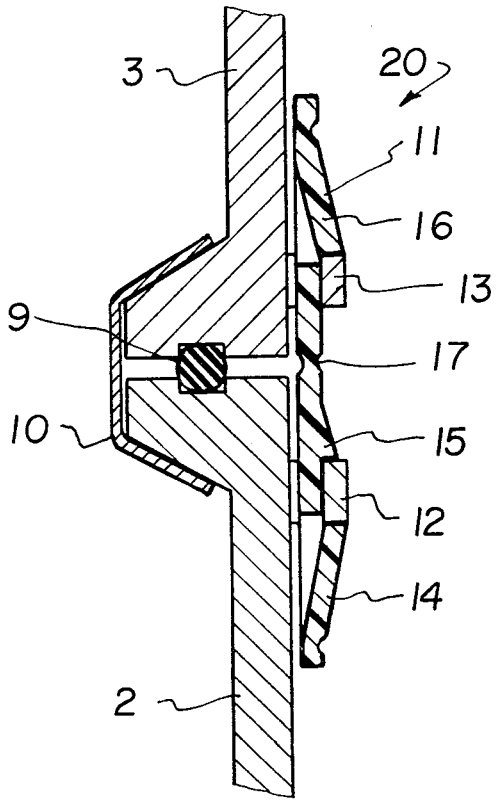
FIG. 2 is an enlarged sectional view of a safety lock from FIG. 1.

Turning to the drawing in particular, the invention embodied therein, in FIG. 1, comprises a gas-tight receptacle for a respirator which includes a cover part 3, a bottom part 2, a seal 9 between the cover and bottom parts, and a clamping means for example a strap 10, for holding the two parts together.

Figure 3:
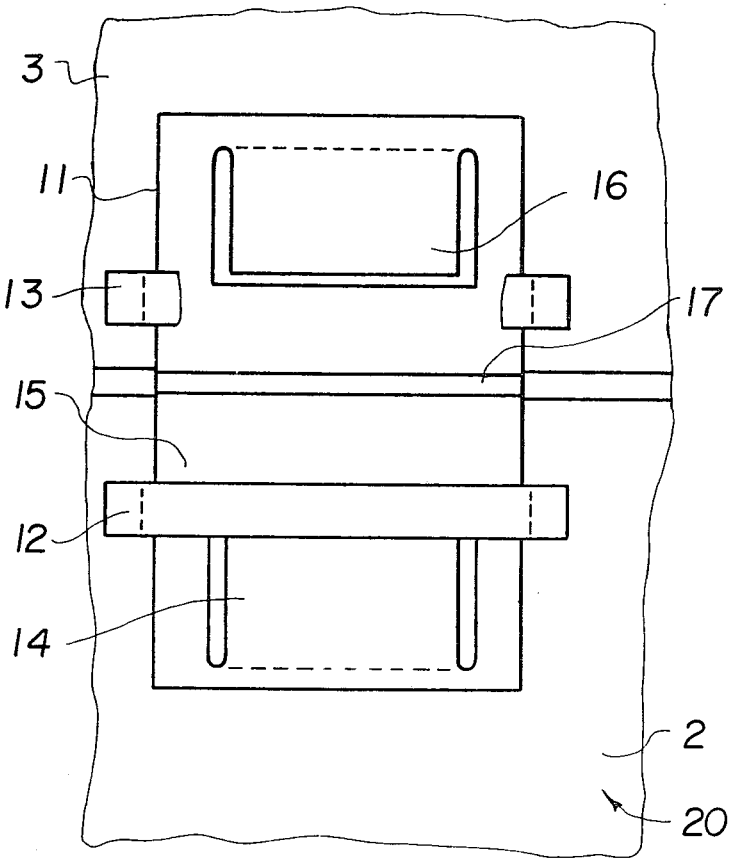
FIG. 3 is a front elevational view of the safety lock viewed from the inside, and toward the receptacle wall.

The readiness receptacle 1 consists of a receptacle bottom part 2 and a cover 3. It contains a $KO_2$-based respirator 4. The respirator comprises a mouthpiece 5 with an accordion tube connecting it with a chemical cartridge 6, and a breathing bag 7. The chemical cartridge 6 is equipped with a chlorate starter 8. The bottom part 2 of the receptacle and the cover 3 are connected together in a watervaporproof manner, through a seal 9. Sufficient contact pressure is obtained through a metal strap 10. The tension force of the strap is produced by a tension lever not shown. The tension lever is fixed in the tensioning position by means of a lead seal. To prevent a falling apart of the readiness receptacle 1 into its bottom part 2 and its cover 3, and hence exposure of the respirator 4, even after inadvertent opening of the strap, the receptacle 1 has in addition a safety lock 20. This includes a plastic or steel shaped part 11 which interconnects the two receptacle parts 2 and 3 in a lower eyelet 12 in the bottom part 2 and an upper eyelet 13 disposed thereabove in the cover 3. These eyelets form slots for receiving the part 11. Before the cover is placed on the bottom part 2, the part 11 is inserted into the lower eyelet 12 of the bottom part. As seen in FIG. 3, each eyelet is an elongated U-shaped member, connected at either end to an inner wall of the receptacle part. The part 11 is held in eyelet 12 against axial displacement by a lower elastic tongue 14 and a projection or stop 15. As the cover 3 is placed on the bottom part 2, an upper elastic tongue 16 of the safety lock part or lock member 11, engaged behind the upper eyelet 13.

Removal of the cover 3, even after strap 10 has been opened, is possible only after destruction of the safety lock 11. To this end it has a tear line or weakened area 17 at the level of the seal line between the bottom part 2 and the cover 3. The tear line can be destroyed only by bending the cover 3 open (that is turning up and over to the left in FIG. 1).

If the safety lock 11 remains undamaged despite the open strap 10, the readiness receptacle 1 can be closed again without complicated testing of the respirator 4.

While a specific embodiment of the invention has been shown and described in detail to illustrate the application of the principles of the invention, it will be understood that the invention may be embodied otherwise without departing from such principles.

What is claimed is:

1. In a gas tight receptacle, particularly for an emergency respirator, which includes a bottom part, a cover part, a seal between the bottom and cover parts and closure means holding the parts together, a safety lock comprising:

an eyelet connected in the cover part;

an eyelet connected in the bottom part; and a locking member having a first elastic tongue and stop engaged with one of the eyelets for holding the locking member fixed with respect to the one eyelet, a second elastic tongue engaged with the other eyelet for holding the locking member fixed with respect to the second eyelet in at least one direction, the locking member having a weakened area adapted to be broken for removal of the cover part from the bottom part.

2. In a gas tight receptacle, a safety lock according to claim 1, wherein the locking member is made of one of the material chosen from the group comprising brittle plastic and hardened steel.

3. In a gas tight receptacle, a safety lock according to claim 2, wherein the brittle plastic comprises polycarbonate.

4. In a gas tight receptacle, a safety lock according to claim 1, wherein said weakened area comprises a tear line extending across said locking member and substantially aligned with a parting line between the cover and bottom members.

* * * * *